US006026904A

United States Patent [19]

Burd et al.

[11] Patent Number: 6,026,904

[45] Date of Patent: Feb. 22, 2000

[54] METHOD AND APPARATUS FOR COMMINGLING AND PRODUCING FLUIDS FROM MULTIPLE PRODUCTION RESERVOIRS

[75] Inventors: James A. Burd; Kenneth J. Huber, both of Anchorage, Ak.

[73] Assignee: Atlantic Richfield Company, Los Angeles, Calif.

[21] Appl. No.: 09/110,167

[22] Filed: Jul. 6, 1998

[51] Int. Cl.[7] ..... E21B 43/14

[52] U.S. Cl. ..... 166/313; 166/105; 166/106; 166/370; 166/372

[58] Field of Search ..... 166/54.1, 105, 166/105.5, 105.6, 106, 313, 369, 370, 372

[56] References Cited

U.S. PATENT DOCUMENTS

| | | | |
|---|---|---|---|
| 2,077,911 | 4/1937 | Van Voorhis | 166/106 X |
| 3,638,731 | 2/1972 | Driscoll | 166/369 |
| 4,335,786 | 6/1982 | Smith | 166/106 |
| 4,444,253 | 4/1984 | Smith et al. | 166/106 X |
| 4,726,420 | 2/1988 | Weeks | 166/372 X |

FOREIGN PATENT DOCUMENTS

| | | |
|---|---|---|
| 0717818 B1 | 6/1996 | European Pat. Off. . |
| 2101216A | 1/1983 | United Kingdom . |
| 2239676A | 7/1991 | United Kingdom . |
| 2264147A | 8/1993 | United Kingdom . |

OTHER PUBLICATIONS

"High Pressure Wells Drive Low Pressure Producers", M.M. Sarshar, Offshore, Aug. 1984, pp. 52, 54.

*Primary Examiner*—George Suchfield
*Attorney, Agent, or Firm*—D. Faulconer

[57] ABSTRACT

A method and apparatus for commingling and producing fluids from an upper and lower reservoir wherein one of the reservoirs has a greater flow capacity than does the other. A jet pump is positioned adjacent the upper reservoir and uses the fluid from the higher-flow capacity reservoir as the power fluid for the pump. As the power fluid flows through a nozzle in the pump, it creates a lowered-pressure zone which sucks in the produced fluids from the other reservoir thereby forming a commingled stream of fluids. Where the upper reservoir has the greater flow capacity, a first embodiment of the pump uses the fluids from the upper reservoir as the power fluid. Where the lower reservoir has the greater flow capacity, the situation is reversed and a further embodiment of the pump uses the fluids from the lower reservoir as the power fluid.

11 Claims, 4 Drawing Sheets

METHOD AND APPARATUS FOR COMMINGLING AND PRODUCING FLUIDS FROM MULTIPLE PRODUCTION RESERVOIRS

DESCRIPTION

1. Technical Field

The present invention relates to a method and apparatus for commingling and producing fluids from multiple production reservoirs through a single wellbore and in one of its aspects relates to method and apparatus for commingling fluids from at least two subterranean reservoirs and producing the combined fluids to the surface by positioning a jet pump in the wellbore adjacent the uppermost of the two reservoirs and then using the fluid flow from the reservoir having the higher flow capacity as a power fluid for the pump thereby reducing the back pressure on the fluids from the low-flow capacity reservoir which, in turn, results in an increase in production.

2. Background

In some areas where hydrocarbons are produced from subterranean formations, a single production wellbore may pass through two or more separate and distinct production formations or reservoirs. It is not uncommon to commingle the produced fluids from the spaced reservoirs together and then produce the combined stream to the surface through a single production tubing string. Unfortunately, however, the flow capacities (permeabilities and pressures) of the respective reservoirs can vary substantially which can cause problems when commingling these fluids.

For example, where fluids produced from a high-flow capacity reservoir (e.g. a reservoir having a relatively high permeability and pressure) are commingled with fluids from a low-flow capacity reservoir (e.g. a reservoir having a relatively low permeability and pressure), commingling the two fluids results in the production from the low-flow capacity reservoir being hydraulically limited by the production from the high-flow capacity reservoir.

Past and current attempts to improve the production efficiency in commingled production streams from separate reservoirs having substantially different flow capacities have included (a) the installation of downhole chokes or restrictions in well tubing (i.e. mandrels/valves) adjacent the high-flow reservoir:, (b) treatment of the high-flow reservoir to change its flow profile (e.g. cement squeeze, polymer treatment, etc.); (c) completely shutting-in the high-flow reservoir and producing only from the low-flow reservoir; and (d) similar techniques. In some extreme instances, a second well has been drilled so that each reservoir can be produced separately. As will be readily understood by those skilled in this art, these solutions are often inefficient and at best, are very expensive to implement successfully.

Accordingly, a need exists for commingling production streams from high-flow capacity and low-flow capacity reservoirs through the same wellbore without encountering the adverse production impacts and costs often associated with the known prior art techniques.

SUMMARY OF THE INVENTION

The present invention provides a method and apparatus for commingling and producing fluids from an upper subterranean reservoir and a lower subterranean reservoir through a single wellbore wherein one of the reservoirs has a greater or higher and flow capacity than does the other. Basically, a jet pump is positioned in the wellbore adjacent the upper reservoir which uses the fluid from the higher-flow capacity reservoir as the power fluid for the pump. This fluid flows through a nozzle in the pump which creates a lowered-pressure zone in the pump which causes the produced fluids from the low-capacity reservoir to be sucked-in and commingled with the produced fluids from the high-flow capacity reservoir. This action effectively adds net lift to the system which will ultimately reduce the flowing bottom-hole pressure of the low-flow capacity reservoir thereby providing a corresponding increase in production.

More specifically, the jet pump of the present invention is comprised of a housing having an outlet and a nozzle chamber therein. The nozzle chamber has an inlet and a nozzle outlet which, in turn, is positioned near the outlet of the housing. The inlet of the nozzle chamber is adapted to receive the fluids from the higher-flow capacity reservoir. The housing also has a passage therethrough, the inlet of which is adapted to receive the fluids from the low-flow capacity reservoir and convey them to the outlet of the housing. As the fluids from the high-flow capacity reservoir exit the nozzle chamber through the nozzle outlet, a lowered-pressure zone is created adjacent the nozzle outlet and the outlet of the housing. Then the low-flow capacity reservoir fluids flowing through the passage will enter this lowered-pressure zone and will become commingled with the high-flow capacity reservoir fluids before the combined streams exit through the outlet of the housing.

Where the upper reservoir has the greater flow capacity, the inlet of the nozzle chamber is adapted to receive the fluids from the upper reservoir while the passage is adapted to receive fluids from the lower formation. Where the lower reservoir has the greater flow capacity, the situation is reversed and the nozzle inlet is adapted to receive the fluids from the lower reservoir while the passage through the pump is adapted to receive the fluids from the upper formation. In both embodiments, the pump is preferably mounted within a commingling sleeve which, in turn, is removably positioned within a landing nipple which forms an integral part of the production tubing which, in turn, is fluidly connected to the outlet of the pump.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
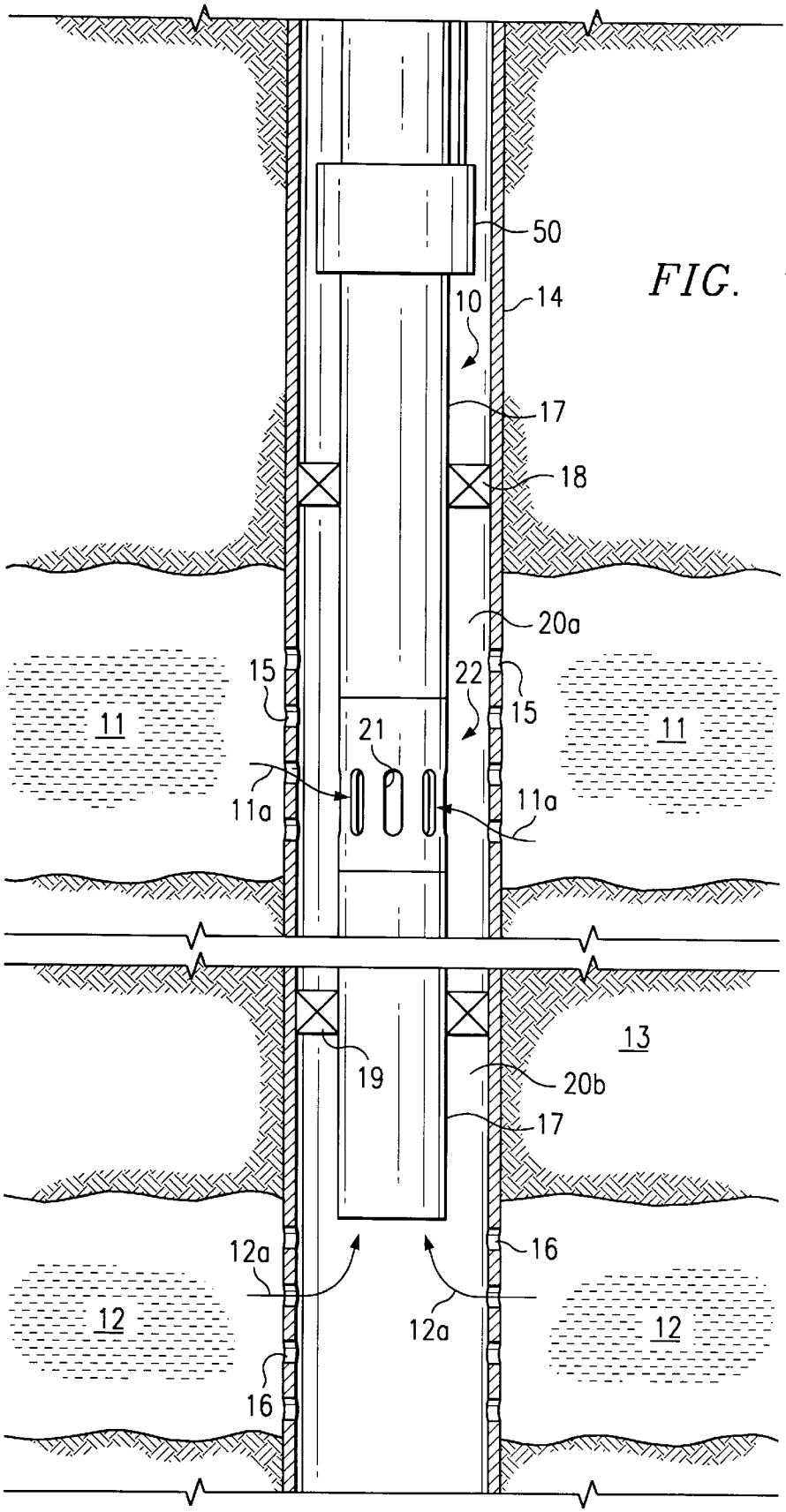
FIG. 1 is an elevational view, partly in section, of a wellbore which passes through two separate subterranean, production reservoirs and which has been completed with the apparatus in accordance with the present invention.
Figure 2:
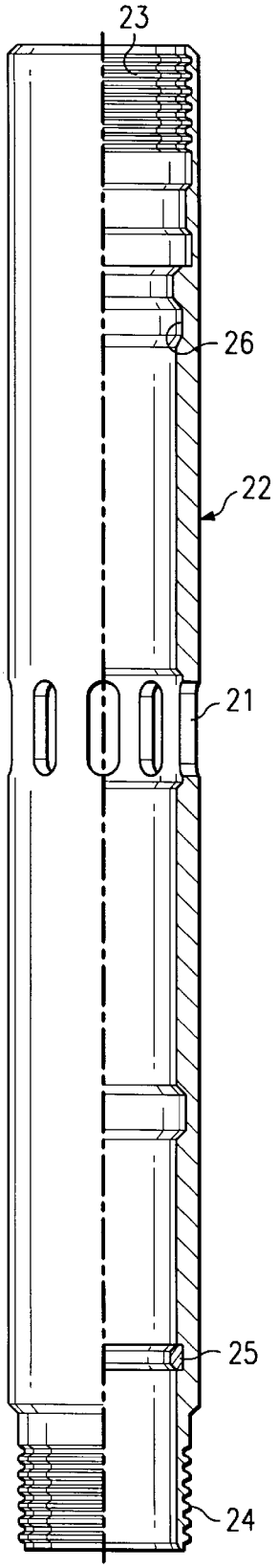
FIG. 2 is an elevational view, partly in section, of a landing nipple which is incorporated into the apparatus of FIG. 1.

Referring more particularly to the drawings, FIG. 1 illustrates the lower portion of a wellbore 10 which has passes through an upper production reservoir 11 and a lower production reservoir 12 which are separated by non-productive formation 13, e.g. shale. As shown, wellbore 10 is cased with casing 14 which, in turn, has a first set of perforations 15 adjacent upper reservoir 11 and another set of perforations 16 adjacent lower reservoir 12 to provide fluid communication between the respective reservoirs and the interior of casing 14.

A string of production tubing 17 is lowered into wellbore 10 and terminates at approximately the top of lower reservoir 12. As will be understood in the art, packers 18 and 19 are carried on tubing 17 and when set, will isolate those sections 20*a*, 20*b* of the well annulus which lie adjacent upper reservoir 11 and lower reservoir 12, respectively. During production, fluids (arrows 12*a* in FIG. 1) will flow from lower reservoir 12, through perforations 16, and into the tubing string 17. For simplicity, tubing 17 is shown as being open at its lower end but it will recognized that a slotted liner (not shown) or the like may be attached to the lower end of tubing 17 through which fluids 12*a* would enter into tubing 17. Fluids (arrows 11*a* in FIG. 1) will flow from upper reservoir 11, through perforations 15 and into tubing 17 through openings 21 in landing nipple 22 which, in turn, is made-up as an integral part of tubing string 17.

Figure 3:
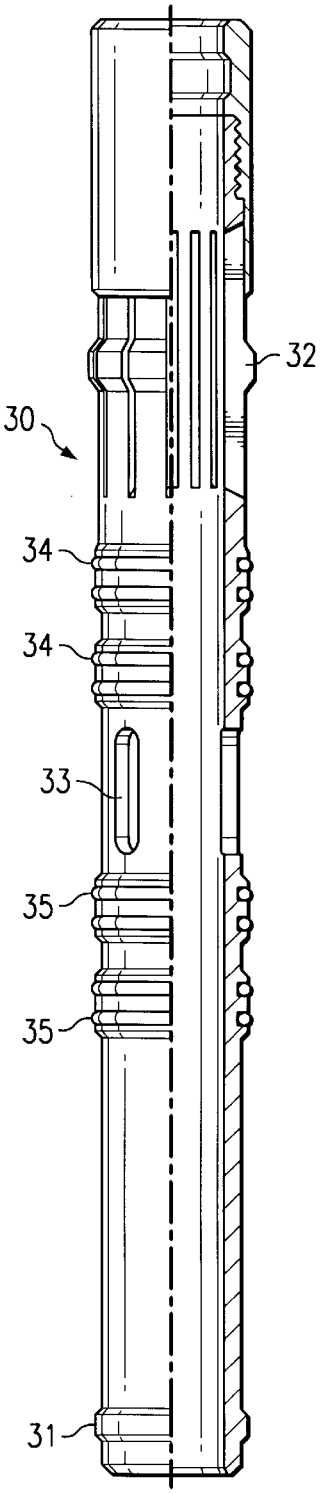
FIG. 3 is an elevational view, partly in section, of a commingling sleeve adapted to fit within the landing nipple of FIG. 2.
Figure 4:
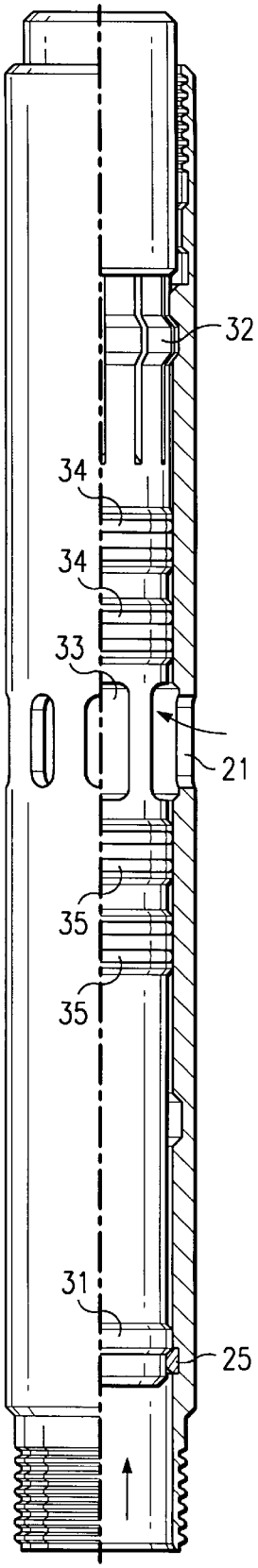
FIG. 4 is an elevational view, partly in section, of the commingling sleeve of FIG. 3 in an assembled position within the landing nipple of FIG. 2.
Figure 5:
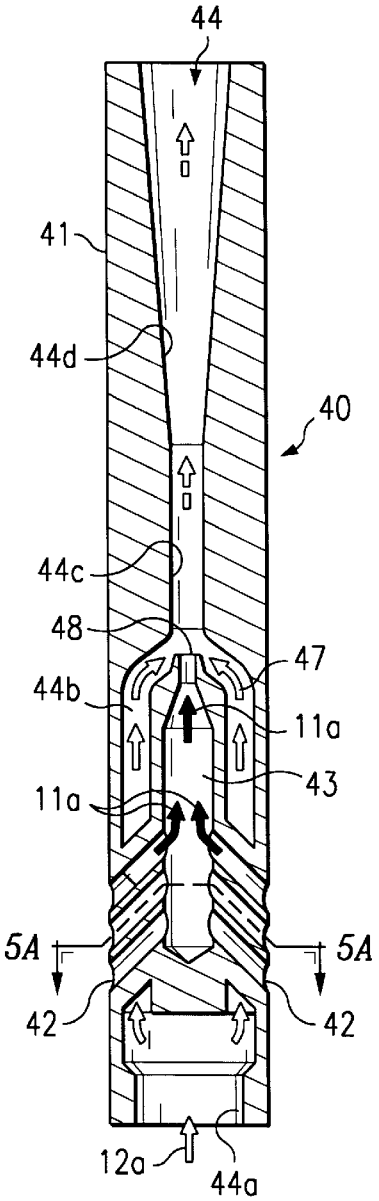
FIG. 5 is an elevational view, partly in section, of a jet pump in accordance with the present invention wherein the production fluids from the uppermost production reservoir is to be used as the power fluid for the pump.

Referring now to FIGS. 3–5, landing nipple 22 is preferably a standard type of a "no go" nipple which is commercially-available and which is commonly used in completions where fluids from separate production reservoirs are to be commingled into a single production tubing string. Landing nipple 22 has threaded box 23 and pin 24 on either end thereof for threadingly connecting nipple 22 into tubing string 17 as the tubing is made-up and lowered into wellbore 10. Landing nipple is adapted to removably receive a standard, commingling sleeve 30 (FIG. 3). As will be understood in the art, sleeve 30 can be assembled into nipple 22 as tubing 17 is lowered into the wellbore 10 or it can be lowered and removed from nipple 17 by a wireline (not shown) or the like after the tubing string is positioned within the wellbore.

Shoulder 31 near the lower end of sleeve 30 will rest on no-go ring 25 within the bore of nipple 22 to thereby support sleeve 30 in its operable position within the nipple. Spring fingers 32 on sleeve 30 having cammed surfaces thereon will expand into grooves 26 in nipple 22 when aligned therewith to releasably latch the sleeve within the nipple as will be understood in the art. The sleeve is oriented so that slots 33 in sleeve 30 will be in alignment with openings 21 in nipple 22 (FIG. 4) when upper reservoir 11 is being produced. Annular seal means 34, 35 are carried on sleeve 30 which prevent fluid flow between nipple 22 and sleeve 30 above and below the aligned openings 22 and slots 33 and insure flow through the aligned openings.

Figure 6:
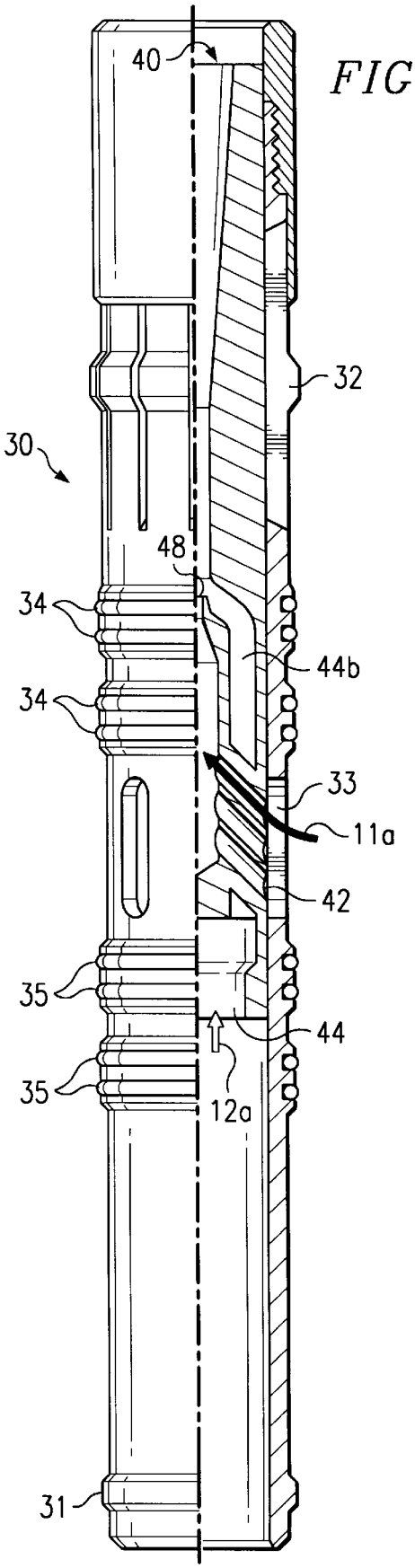
FIG. 6 is an elevational view, partly in section, of the jet pump of FIG. 5 in an assembled position within the commingling sleeve of FIG. 3.

Referring now to FIGS. 5 and 6, a jet pump 40 is positioned and secured within commingling sleeve 30 before sleeve 30 is positioned within nipple 22. For purposes of describing jet pump 40 in FIG. 5, the fluid from reservoir having the greater flow-capacity capacity (i.e. upper reservoir 11 in FIGS. 1, 5, and 6) will be referred to as the "power fluid" (solid black arrows 11*a* in FIG. 5) and the produced fluids from the lower-flow capacity reservoir (i.e. lower reservoir 12 in FIGS. 1, 5, and 6) will be referred to as the "produced fluids" (white arrows 47).

Figure 5A:
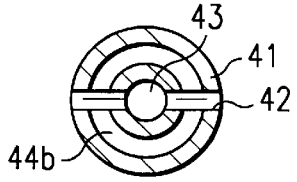

More specifically, jet pump 40 is comprised of a housing 41 which, in turn, has a power fluid inlet (shown in FIG. 5 as a plurality of passages 42) which opens into nozzle chamber 43 which, in turn, has a jet orifice or nozzle outlet 48. Housing 41 has an axial passage 44 therethrough, through which the produced fluids from lower reservoir 12 flows. Passage 44 has an inlet 44*a* which is fluidly connected into pump outlet or throat 44*c* by an annular passage portion 44*b* which extends basically parallel to and surrounds nozzle chamber 43 (see FIG. 5A).

In operation, pump 40 may be affixed within commingling sleeve 30 by welding or the like or the pump 40 can be removably secured in sleeve 30, if desired. Once the pump is assembled within the sleeve, sleeve 30 is positioned within nipple 22 as described above. When in its operable position, the power fluid inlet 42 of pump 40 will be aligned with slots 33 in sleeve 30 which, in turn, will be aligned with openings 21 in nipple 22.

Upper reservoir 11 and lower reservoir 12 are then both opened for production. The produced fluid 12*a* flows upward through tubing 17 and into low-pressure inlet 44*a* of jet pump 40. At the same time, power fluid 11*a* from upper reservoir 11 flows through openings 21, slots 33, power fluid inlets 42, and into nozzle chamber 43 of jet pump 40 from which it is forced out through the restricted, small-diameter jet nozzle 48. This, in effect, converts the power fluid (i.e. oil, gas, water) from the upper reservoir 11 into a high velocity stream directed upward into the tubing. Due to the known Bernoulli effect, this high velocity stream creates an area or zone of relatively low pressure adjacent to the nozzle outlet 48 which, in turn, "sucks" in the produced fluid 12*a* as fluid 12*a* flows through passage 44 and past nozzle outlet 48.

Produced fluid 12*a* becomes entrained into the power fluid 11*a* as the two meet at the jet outlet 48 and enter into the outlet or throat 44*c* of pump 40. In throat 44*c* of the pump, energy is transferred from the power fluid 11*a* to the produced fluid in the form of momentum. The combined or commingled stream then enters the diffuser section 44*d* of the jet pump 40 which, in turn, converts the high velocity head of the stream into a pressure head sufficient to overcome the static pressure head of the column of fluid in tubing string 17 above the pump 40 whereby the commingled stream is produced to the surface through the single string of tubing 17. In many instances, the pressures and flowrates of the respective production reservoirs will be such that the boost provided by the jet pump will be sufficient to produce the commingled fluids to the surface without further assistance. However, it will be readily recognized that, in other instances, the efficiency of the system of the present invention may be greatly enhanced when combined with other well known artificial lift mechanisms, e.g. gas lift valves 50 (only one shown in FIG. 1) spaced along the tubing string above the jet pump.

Figure 7:
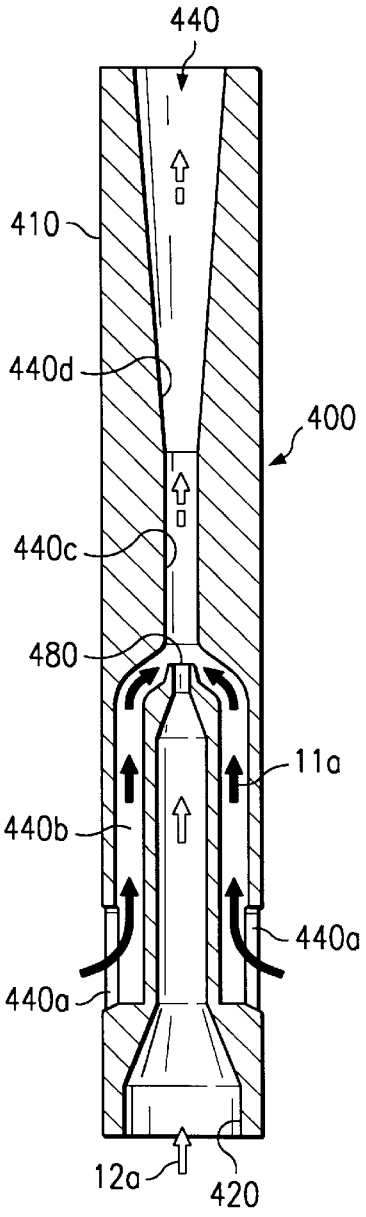
FIG. 7 is an elevational view, partly in section, of a jet pump in accordance with the present invention wherein the production fluids from the lowermost production reservoir is used as the power fluid for the pump.
Figure 8:
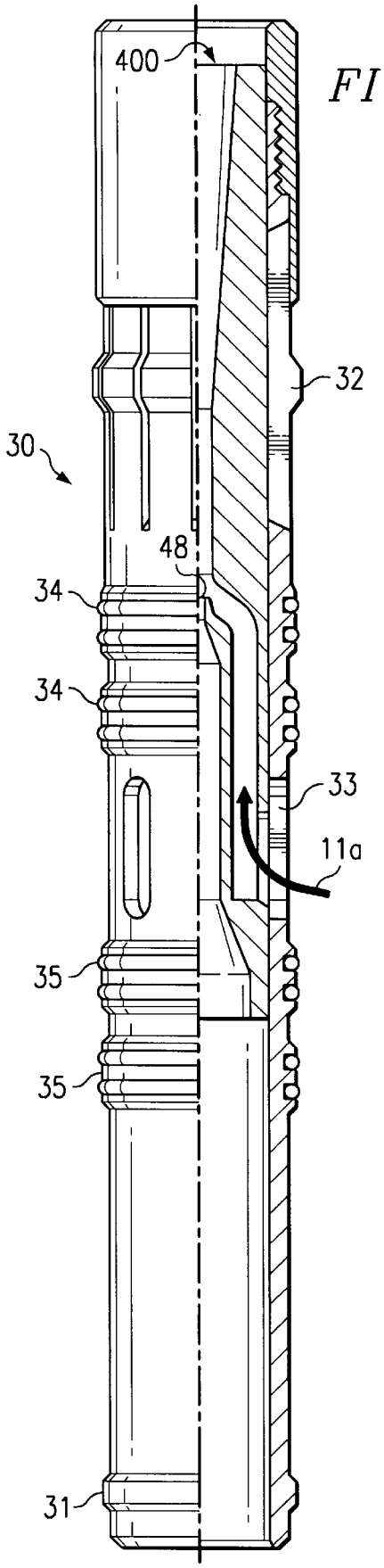
FIG. 8 is an elevational view, partly in section, of the jet pump of FIG. 5 in an assembled position within the commingling sleeve of FIG. 3.

Referring now to FIGS. 7 and 8, an embodiment of the present invention is illustrated wherein the operating parameters of the respective production reservoirs are reversed. That is, lower reservoir 12 (FIG. 1) has a higher flow capacity than does upper reservoir 11. In this embodiment, a jet pump 400 is still positioned adjacent upper reservoir 11 within commingling sleeve 30 which is coupled into tubing string 17 basically in the same manner as described above.

Jet pump 400 is comprised of a housing 410 which has a passage 440 through which the produced fluids from upper reservoir 11 flow through the pump. Passage 440 is comprised of inlet openings 440*a*, a longitudinal portion 440*b*, an outlet or throat portion 440*c*, and diffuser portion 440*d*. The lower end of housing 410 has an inlet 420 for the power fluid 12*a* from lower reservoir 12. Inlet 420 opens into nozzle chamber 430 which, in turn, has a jet orifice or nozzle outlet 480.

In operation, jet pump 400 is positioned within commingling sleeve 30 which is positioned within nipple 22 which, in turn, is positioned within tubing string 17 adjacent the upper production reservoir 11. Produced fluid 11*a* from upper reservoir 11 flows through perforations 15, openings 21 in nipple 22, openings 33 in sleeve 30, and into passage 440 of pump 440 through inlet 440*a*. The produced fluid 11*a* flows through passage 440*b* and out through throat portion 440*c*.

At the same time, power fluid 12*a* from lower reservoir 12 flows through perforations 16 and upward through tubing 17 and into inlet 420 of nozzle chamber 430 of pump 400. The high-pressure of the power fluid 12*a* forces it through the restricted nozzle outlet 480 which, in turn, creates the same low-pressure area of zone around the nozzle as is created in pump 40 described above. This low-pressure zone within the pump causes the two fluids to commingle in the same manner as described above thereby improving the lifting pressure of the combined stream when compared to traditionally-commingled production streams.

While the present invention is not intended to be limited to the following set of operating conditions, the following example is set forth to illustrate a possible environment in which the present invention might find application. Well 10 is drilled and cased through upper and lower production reservoirs 11, 12, respectively. The casing is perforated adjacent both the upper reservoir which lies at a depth of approximately 8240 feet and the lower reservoir which lies at approximately 8400 feet with approximately 150 feet of shale in between.

Upper reservoir 11 is one which is in the mature stage of a water flood operation with the production stream having watercuts of from 70 to 90% and reservoir pressures which average from about 3400 to about 3700 psi. The lower reservoir 12 has a reservoir pressure which average from about 2400 to about 2700 psi and the production stream therefrom averages from 0 to 50%. The flow capacity of upper reservoir 11, as measured by the productivity index (PI) is significantly greater (e.g. up to 10 times) than that of lower reservoir 12; PI being measured in barrels per day divided by the bottom-hole pressure drawdown. If commingled in accordance with typical, prior art techniques, the production from the high-flow capacity reservoir stream will hydraulically curtailed or substantially reduced the production from the low-flow capacity reservoir. That is, the flowing, bottom-hole pressure of commingled stream will be approximately 2500 to about 2700 psi. Consequently, the drawdown (i.e. reservoir pressure minus flowing bottom-hole pressure) on the low-flow capacity reservoir will be minimal. From this, it can be seen that any expected increase in production resulting from opening up the high-flow capacity reservoir to production will be negated or substantially reduced. The reason for this is that the additional production supplied to the system by the high-flow capacity reservoir will increase the back-pressure (i.e. higher flowing bottom-hole pressure) on the low-flow capacity reservoir, thus backing out production.

In the present invention, by using jet pump 40 adjacent the upper reservoir, the flowing bottom-hole pressure seen by the low-flow capacity reservoir can effectively be reduced by as much as 50% which, in turn, means an increase in drawdown on the reservoir and ultimately an increased production rate. Again, additional artificial lift means (e.g. gas lift valves may be spaced along the production tubing above the jet pump to lower the hydraulic head above the pump which, in turn, allows more momentum energy transfer between the power fluid and the produced fluid within the pump, itself.

What is claimed is:

1. A method for commingling and producing fluids from an upper subterranean reservoir and a lower subterranean reservoir through a single wellbore wherein one of said reservoirs has a greater flow capacity than that of the other of said reservoirs, said method comprising:

placing a jet pump in said wellbore adjacent said upper reservoir;

flowing fluids from said one reservoir as a power fluid through a nozzle outlet in said pump to create a lowered pressure zone around said nozzle outlet within said pump;

flowing fluids from said other of said reservoirs as produced fluids into said lowered pressure zone within said pump to commingle said fluids into a commingled stream; and producing said commingled stream upward from said pump through said wellbore.

2. The method of claim 1 wherein said one of said reservoirs is comprised of said upper reservoir and said other of said reservoirs is comprised of said lower reservoir.

3. The method of claim 1 wherein said one of said reservoirs is comprised of said lower reservoir and said other of said reservoirs is comprised of said upper reservoir.

4. Apparatus for commingling and producing fluids from an upper subterranean reservoir and a lower subterranean reservoir through a single wellbore wherein one of said reservoirs has a greater flow capacity than that of the other of said reservoirs, said apparatus comprising:

a jet pump adapted to be positioned within said wellbore adjacent said upper reservoir, said jet pump comprising:

a housing having an outlet and a nozzle chamber therein;

said nozzle chamber having an inlet for receiving the fluids from said one of said reservoirs as a power fluid and a nozzle outlet;

said housing having a passage therethrough, said passage having an inlet for receiving the fluids from said other of said reservoirs as produced fluids and an outlet adjacent said nozzle outlet of said nozzle chamber whereby fluids from said upper and lower reservoirs will be commingled adjacent said nozzle outlet before exiting through said outlet of said housing; and a tubing string in said wellbore and in fluid communication with said outlet of said housing for producing the commingled fluids upward through said wellbore.

5. The apparatus of claim 4 including:

a landing nipple assembled into said string of tubing and adapted to lie adjacent said upper reservoir when said string of tubing is in its operable position within said wellbore wherein said jet pump is positioned within said tubing nipple, said nipple having opening therein to provide fluid communication between said upper reservoir and said pump.

6. The apparatus of claim 4 including:

a landing nipple having openings therein, said nipple being assembled into said string of tubing and adapted to lie adjacent said upper reservoir when said string of tubing is in its operable position within said wellbore;

a commingling sleeve within said landing nipple and having openings aligned with said openings in said nipple; and wherein said jet pump is positioned within said commingling sleeve and is in fluid communication with the aligned openings in said commingling sleeve and said landing nipple.

7. The apparatus of claim 5 wherein said inlet for nozzle chamber is aligned with said openings in said landing nipple to receive said power fluid from said upper reservoir.

8. The apparatus of claim 5 wherein said inlet for said passage through said housing is aligned with said openings in said landing nipple to receive said power fluid from said lower reservoir.

9. A jet pump for commingling and producing fluids from an upper subterranean reservoir and a lower subterranean reservoir through a single wellbore wherein one of said reservoirs has a greater flow capacity than that of the other of said reservoirs and wherein said jet pump is adapted to be positioned within said wellbore adjacent said upper reservoir, said jet pump comprising:

a housing having an outlet and a nozzle chamber therein;

said nozzle chamber having an inlet for receiving the fluids from said one of said reservoirs as a power fluid and a nozzle outlet;

said housing having a passage therethrough, said passage having an inlet for receiving the fluids from said other of said reservoirs as a produced fluid and an outlet adjacent said nozzle outlet of said nozzle chamber whereby fluids from said upper and lower reservoirs will be commingled adjacent said nozzle outlet before exiting through said outlet of said housing; and means for connecting said outlet of said housing to a production tubing string.

10. The jet pump of claim 9 wherein said inlet of said nozzle chamber is adapted to receive said power fluid from said upper reservoir and said inlet into said passage is adapted to receive said produced fluids from said lower reservoir.

11. The jet pump of claim 9 wherein said inlet of said nozzle chamber is adapted to receive said power fluid from said lower reservoir and said inlet into said passage is adapted to receive the said produced fluid from said upper reservoir.

* * * * *